US007586486B2

(12) United States Patent
Sasaki et al.

(10) Patent No.: US 7,586,486 B2
(45) Date of Patent: Sep. 8, 2009

(54) DISPLAY PANEL DRIVING APPARATUS

(75) Inventors: Mikio Sasaki, Yamanashi-ken (JP); Toyohisa Yuasa, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 766 days.

(21) Appl. No.: 11/193,326

(22) Filed: Aug. 1, 2005

(65) Prior Publication Data

US 2006/0022905 A1 Feb. 2, 2006

(30) Foreign Application Priority Data

Aug. 2, 2004 (JP) ..... 2004-225409

(51) Int. Cl.
*G09G 5/00* (2006.01)

(52) U.S. Cl. ..... 345/204; 345/60; 345/63; 345/95

(58) Field of Classification Search ..... 345/204, 345/60, 63, 95
See application file for complete search history.

(56) References Cited

FOREIGN PATENT DOCUMENTS

JP 10-268831 * 10/1998
JP 10-301530 * 11/1998
JP 2003-140602 5/2003

* cited by examiner

*Primary Examiner*—Richard Hjerpe
*Assistant Examiner*—Leonid Shapiro
(74) *Attorney, Agent, or Firm*—McGinn IP Law Group, PLLC

(57) ABSTRACT

A display panel driving apparatus which reduces a peak value of a voltage/current upon charging or discharging of discharging cells on a display panel. The apparatus has a pulse generating part for supplying a driving pulse to a capacitive light-emitting device arranged in each of crossing positions of a plurality of row electrode pairs and column electrodes on the display panel of the display panel driving apparatus. The pulse generating circuit includes a charge/discharge resonance circuit for executing charging and discharging to the capacitive light-emitting devices through an inductor, and a harmonic multiplexing circuit for multiplexing a harmonic current having a harmonic frequency of a resonance frequency of the charge/discharge resonance circuit to a charge/discharge current by the charge/discharge resonance circuit.

4 Claims, 9 Drawing Sheets

DISPLAY PANEL DRIVING APPARATUS

BACKGROUND OF THE INVENTION

1. Field of the Invention

The invention relates to a driving apparatus or the like of a display panel such as a plasma display panel (hereinbelow, abbreviated to "PDP") including capacitive light emitting devices.

2. Description of the Related Art

Nowadays, a thin display apparatus using a flat display panel of a spontaneous light emitting type such as a PDP has been put into the market as what is called a wall-mounted television. As a display panel driving apparatus in the thin display apparatus using the PDP, for example, a technique as shown in Japanese Patent Kokai No. 2003-140602 (Patent Document 1) has been disclosed.

A schematic construction of the display panel driving apparatus disclosed in Patent Document 1 is shown in a block diagram of FIG. 1. In the diagram, a PDP 10 as a display panel has row electrodes X1 to Xn and row electrodes Y1 to Yn. A row electrode pair corresponding to each of the rows (the first row to the nth row) of one display screen is constructed by a pair of X electrode and Y electrode. Column electrodes Z1 to Zm corresponding to the columns (the first column to the mth column) of one display screen are further formed on the PDP 10 so as to perpendicularly cross the row electrode pairs and sandwich a dielectric layer and a discharge space layer (both are not shown). One discharging cell $C_{(i,j)}$ is formed in a crossing position of one row electrode pair (Xi, Yi) and one column electrode Zj. Each electrode of the PDP 10 is connected to a column electrode driving circuit 20 and a row electrode driving circuit 30 or 40. The electrode driving circuits are driven by a command from a drive control circuit 50.

The schematic operation of the display panel driving apparatus shown in FIG. 1 will now be described with reference to an operation time chart shown in FIG. 2.

First, the row electrode driving circuit 30 generates a reset pulse RPy of a positive voltage as shown in FIG. 2 and simultaneously applies it to each of the row electrodes Y1 to Yn. At the same time, the row electrode driving circuit 40 generates a reset pulse RPx of a negative voltage and simultaneously applies it to all of the row electrodes X1 to Xn. By simultaneously applying the reset pulses RPx and RPy, all discharging cells of the PDP 10 are discharge-excited and charged particles are generated. After termination of the discharge, a predetermined amount of wall charges are uniformly formed in the dielectric layer of all of the discharging cells. The processing step is called a resetting step.

After the end of the resetting step, the column electrode driving circuit 20 generates pixel data pulses DP1 to DPn according to pixel data corresponding to the first to nth rows of the display screen and sequentially applies the pixel data pulses to the column electrodes Z1 to Zm as shown in FIG. 2. The row electrode driving circuit 30 generates a scanning pulse SP of the negative voltage in accordance with the applying timing of each of the pixel data pulses DP1 to DPn and sequentially applies it to the row electrodes Y1 to Yn at the timing shown in FIG. 2.

Among the discharging cells belonging to the row electrode to which the scanning pulse SP has been applied, a discharge further occurs in the discharging cells to which the pixel data pulse DP of the positive voltage has simultaneously been applied and almost of the wall charges are lost. In the discharging cells to which the pixel data pulse DP of the positive voltage is not applied although the scanning pulse SP has been applied, since no discharge occurs, the wall charges remain. In this instance, the discharging cells in which the wall charges remain become the light-emission discharging cells. The discharging cells in which the wall charges have been extinguished become the non-light-emission discharging cells. The processing step is called an addressing step.

After the end of the addressing step, the row electrode driving circuit 30 continuously supplies a sustaining pulse IPy of the positive voltage as shown in FIG. 2 to each of the row electrodes Y1 to Yn. At the same time, the row electrode driving circuit 40 continuously supplies a sustaining pulse IPx of the positive voltage to each of the row electrodes X1 to Xn at the timing having a predetermined phase difference from the applying timing of the sustaining pulse IPy. For a period of time during which the sustaining pulses IPx and IPy are alternately applied, the light-emission discharging cells in which the wall charges remain repeat the discharge light emission and maintain the light-emitting state. The processing step is called a sustaining step.

The series of processing steps described above is repeated every subfield of a display video image in the display panel driving apparatus of FIG. 1.

On the basis of a sync timing signal included in a video signal supplied to the apparatus, the drive control circuit 50 in FIG. 1 generates various switching signals to form various driving pulses as shown in FIG. 2. The switching signals are supplied to each of the column electrode driving circuit 20 and the row electrode driving circuits 30 and 40. That is, each of the column electrode driving circuit 20 and the row electrode driving circuits 30 and 40 generates various driving pulses shown in FIG. 2 in response to the switching signals supplied from the drive control circuit 50.

A pulse generating circuit to generate the various driving pulses such as reset pulse RPy and sustaining pulses IPx and IPy is provided in each of the electrode driving circuits described above for every electrode of each row and each column. Each of the pulse generating circuits generates the various driving pulses by using charge/discharge of a capacitor by an LC resonance circuit comprising an inductor L and a capacitor C.

That is, by paying attention to a fact that the discharging cell $C_{(i,j)}$ formed on the PDP 10 is a capacitive load, a resonance circuit is formed by combining the inductor as an inductive device and the capacitor for collecting an electric power. A switching device such as an FET is turned on/off in response to the switching signals supplied from the drive control circuit 50 and the resonance circuit is excited at predetermined timing, thereby generating a desired driving pulse.

An example of the pulse generating circuits is shown in FIG. 3. The operation of the circuit shown in the diagram will be simply explained as follows.

First, when a switch S2 is turned on by a predetermined switching signal supplied from the drive control circuit 50, a capacitor C0 for collecting the electric power is connected to a panel capacitor Cp of the discharging cell $C_{(i,j)}$ through a diode D1 and an inductor L1. The capacitor Cp is, consequently, charged by the charges accumulated in the capacitor C0 and a charging current flows in the inductor L1. After that, a predetermined processing operation is executed and, subsequently, a switch S3 is turned on in place of the switch S2. C0 and Cp are, thus, connected through a diode D2 and an inductor L2 and a discharge current from Cp to C0 flows in L2. By repetitively executing the processes at predetermined timing, the discharging cell $C_{(i,j)}$ is driven.

In the conventional pulse generating circuit as described above, since the discharging cell is excited by using the resonance circuit comprising the inductor and the capacitor, the voltage/current of the charge/discharge of the panel capacitor Cp has a sine wave. When the capacitive load such as a PDP is driven, it is generally necessary to apply a relatively high voltage of tens to hundred and tens of volts in order to cause the discharge in the discharging cell $C_{(i,j)}$ and, naturally, a peak value (maximum value) of the charge/discharge voltage of the sine wave also rises. Since a withstanding voltage of each section such as display panel or pulse generating circuit needs to be determined on the basis of the peak value as a reference instead of an effective value of the driving voltage, the increase in peak value becomes a factor of an enlargement in size of the display panel or pulse generating circuit. Naturally, since a peak value of the charge/discharge current of the sine wave also similarly rises, an electric power loss due to a resistance component of each electrode arranged on the display panel or the inductors, diodes, etc. included in the pulse generating circuit increases, so that there is also a problem of deterioration of power collecting efficiency in the display panel apparatus.

SUMMARY OF THE INVENTION

The invention is made to solve the problems and it is an object of the invention to provide a display panel driving apparatus which reduces a peak value of a voltage/current upon charging or discharging of discharging cells on a display panel.

According to the invention disclosed in Claim 1, there is provided a display panel driving apparatus comprising: a display panel constructed by a plurality of row electrode pairs, a plurality of column electrodes arranged so as to cross the row electrode pairs, and capacitive light-emitting devices arranged in crossing positions of the row electrode pairs and the column electrodes; and a pulse generating part for supplying a driving pulse to each of the capacitive light-emitting devices, wherein the pulse generating part includes a charge/discharge resonance circuit for executing charging and discharging to the capacitive light-emitting devices through an inductor and a harmonic multiplexing circuit for multiplexing a harmonic current having a harmonic frequency of a resonance frequency of the charge/discharge resonance circuit to each of a charge current and a discharge current by the charge/discharge resonance circuit.

DETAILED DESCRIPTION OF THE PREFERRED EMBODIMENTS

Figure 1:
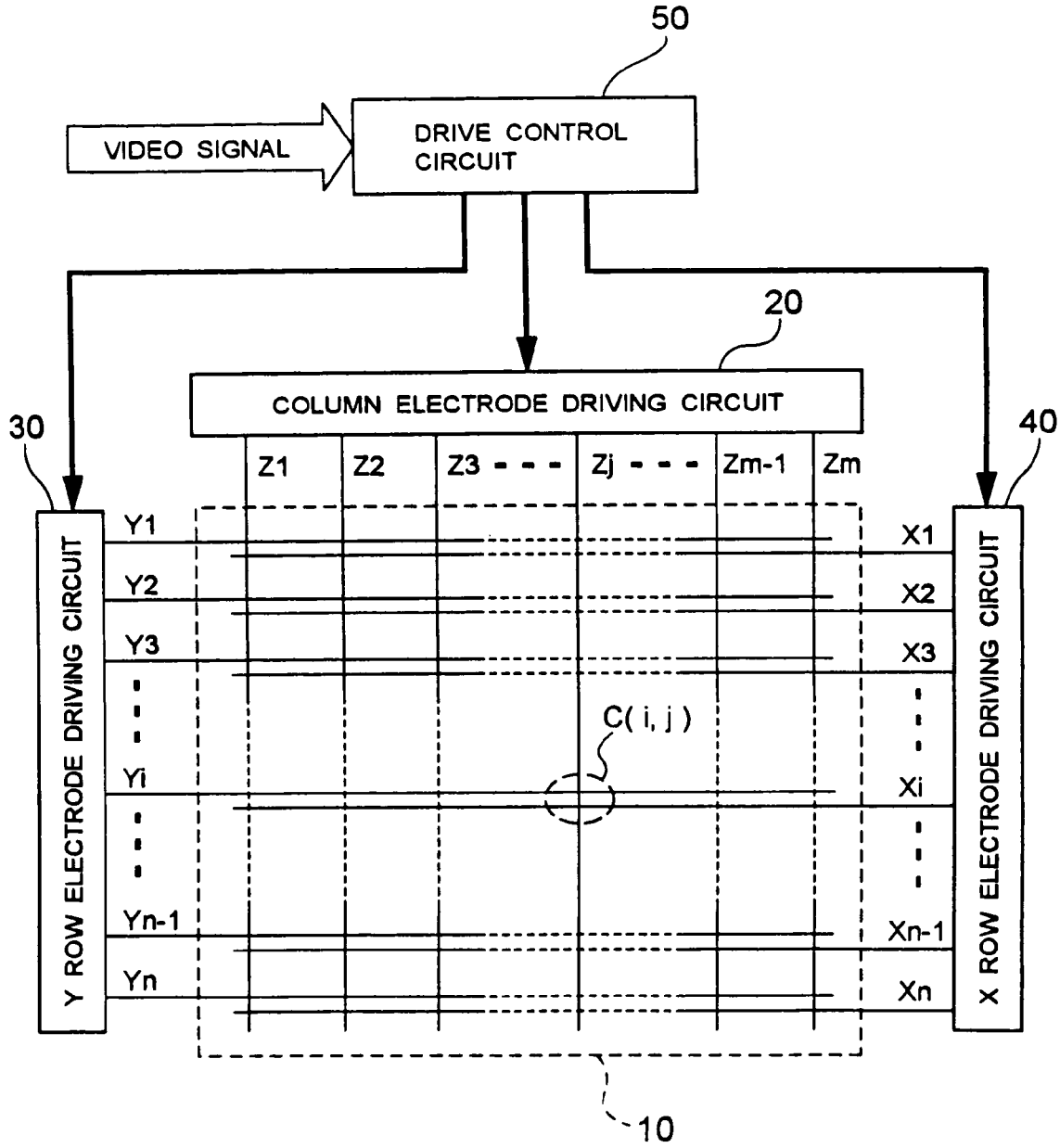
PRIOR ART FIG. 1
FIG. 1 is a block diagram showing a construction of a display panel driving apparatus according to a conventional PDP.
Figure 2:
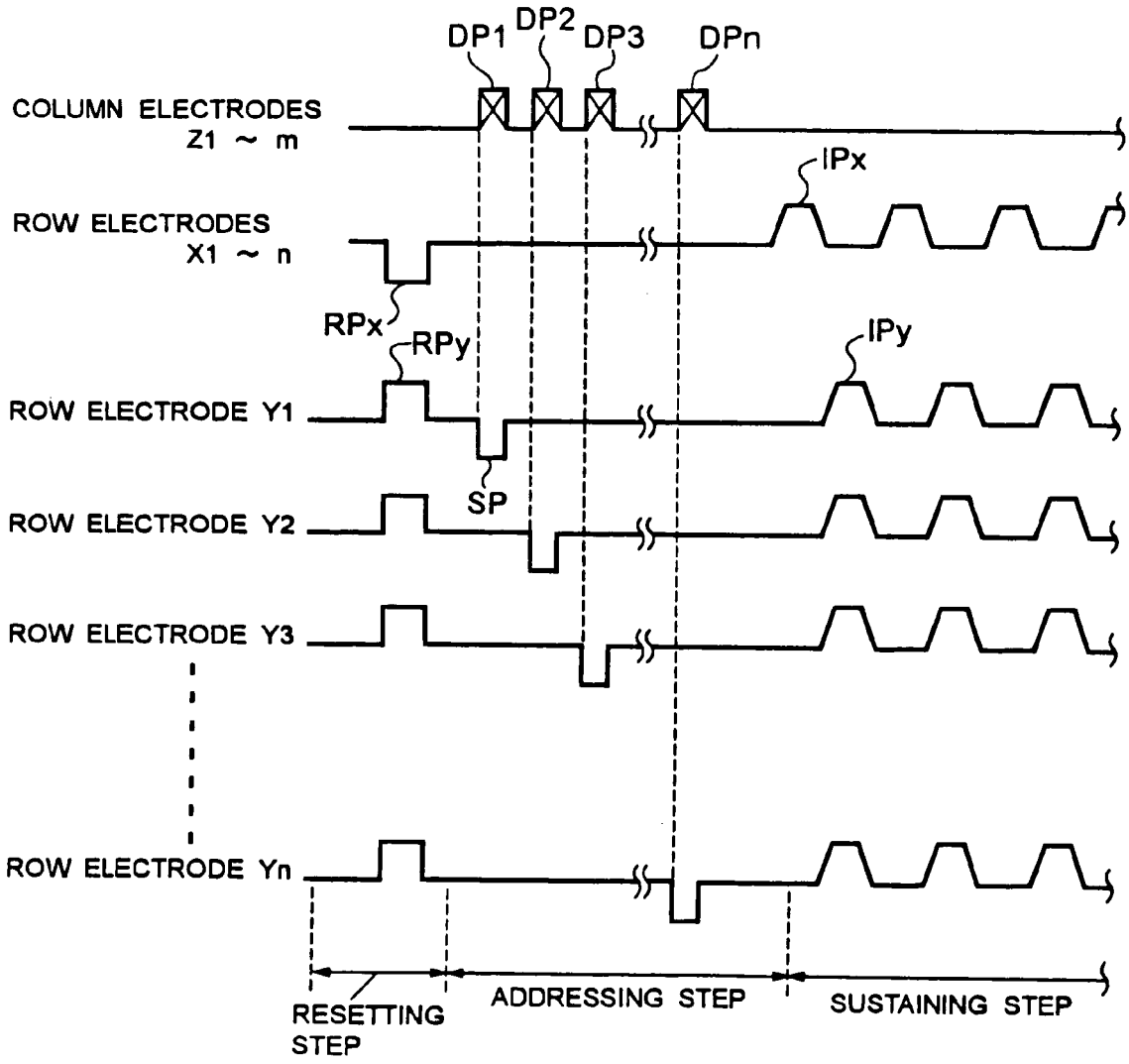
PRIOR ART FIG. 2
FIG. 2 is a time chart showing applying timing of various driving pulses in the apparatus of FIG. 1.
Figure 3:
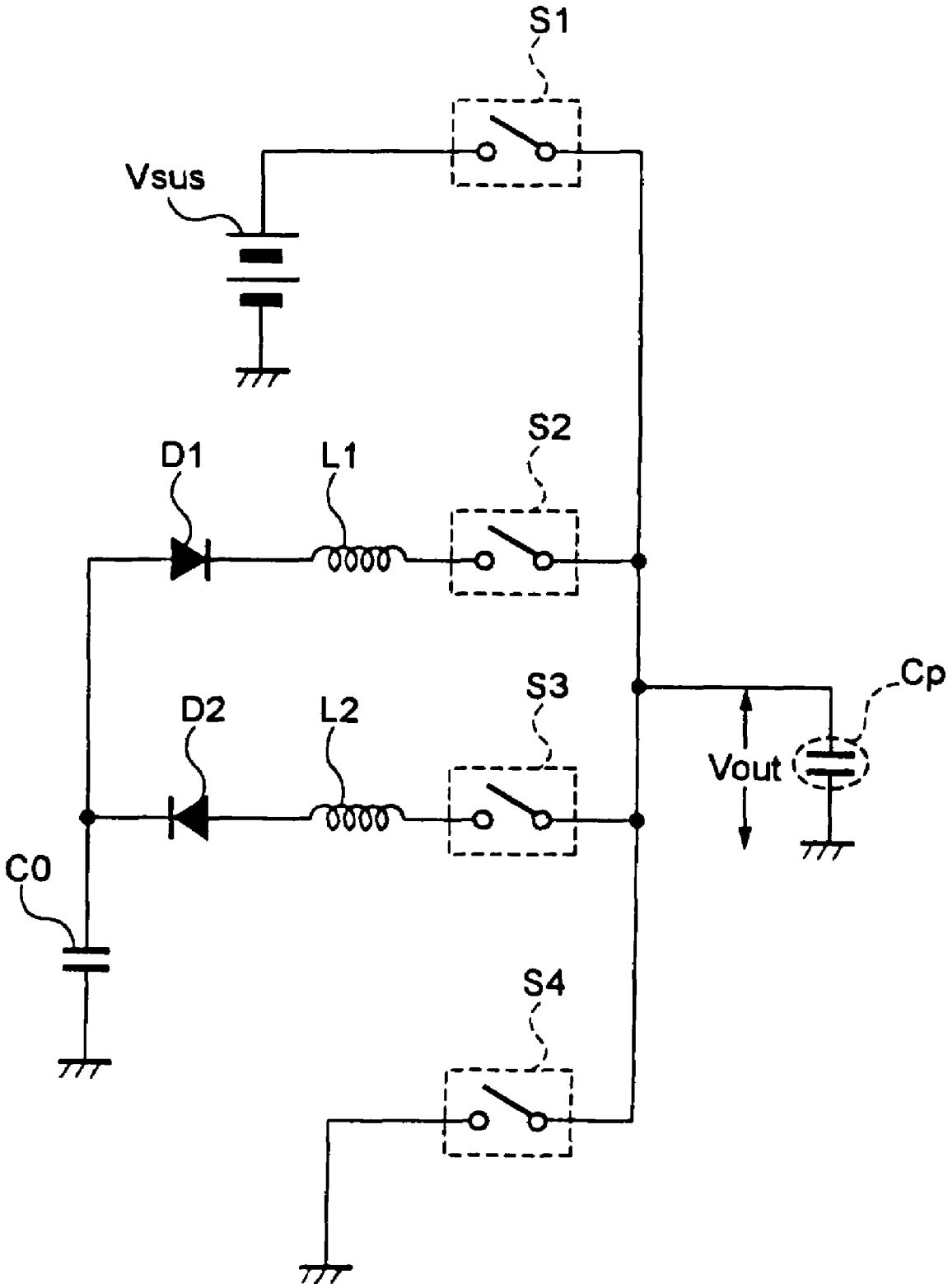
FIG. 3 is a circuit diagram showing a construction of a pulse generating circuit included in each electrode driving circuit in the apparatus of FIG. 1.
Figure 4:
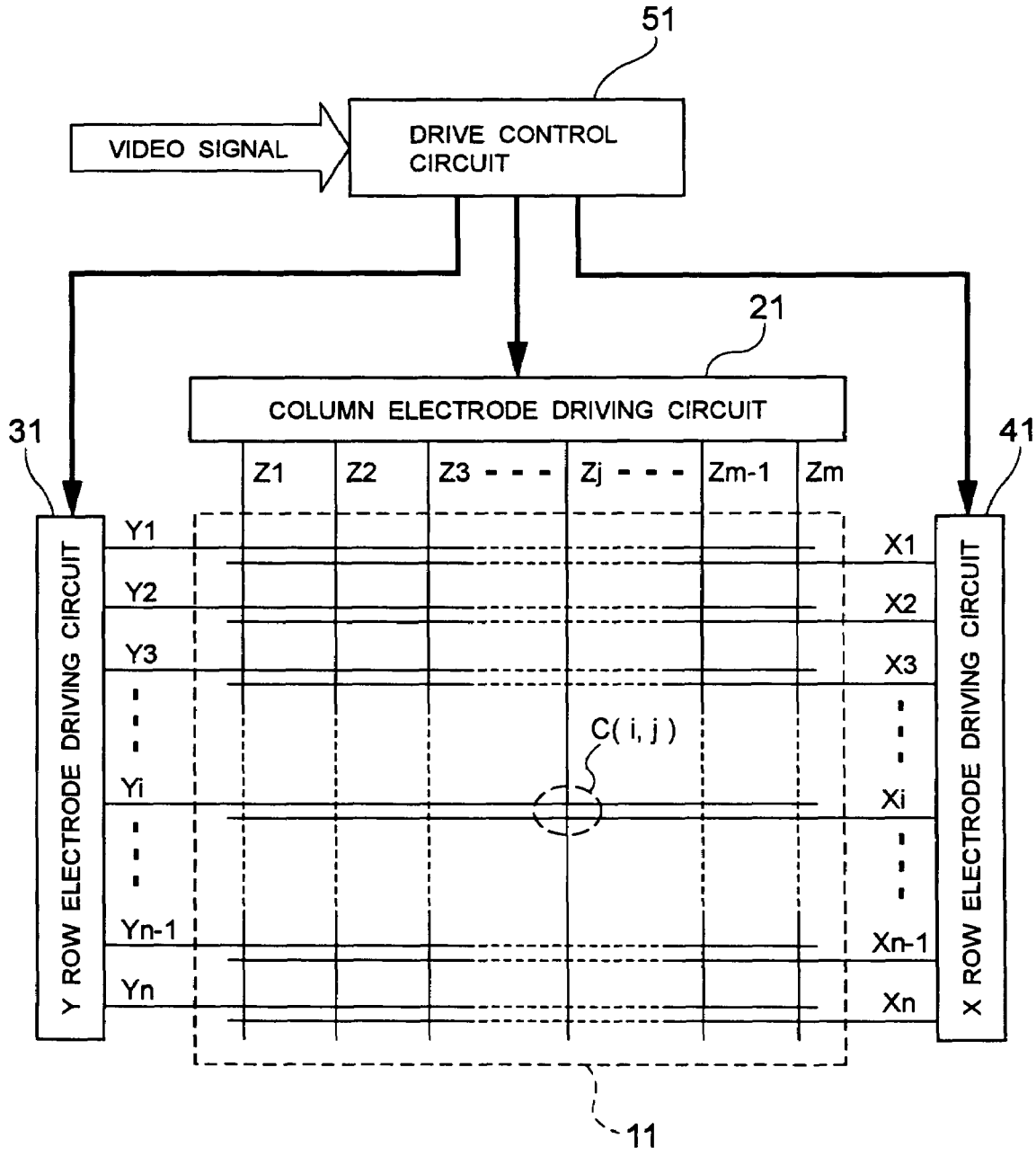
FIG. 4 is a block diagram showing a construction of a display panel driving apparatus according to an embodiment of the invention.

FIG. 4 shows a construction of a display panel driving apparatus according to the first embodiment of the invention.

In the diagram, a PDP 11 as a display panel has the row electrodes X1 to Xn and the row electrodes Y1 to Yn. A row electrode pair corresponding to each of the rows (the first row to the nth row) of one display screen is constructed by a pair of X electrode and Y electrode. The column electrodes Z1 to Zm corresponding to the columns (the first column to the mth column) of one display screen are further formed on the PDP 11 so as to perpendicularly cross the row electrode pairs and sandwich the dielectric layer and the discharge space layer (both are not shown). One discharging cell $C_{(i,j)}$ is formed in a crossing position of one row electrode pair (Xi, Yi) and one column electrode Zj.

Each electrode of the PDP 11 is connected to a column electrode driving circuit 21 and a row electrode driving circuit 31 or 41. The electrode driving circuits are driven by a command from a drive control circuit 51.

The row electrode driving circuit 31 generates various driving pulses such as reset pulse and sustaining pulse as mentioned above and supplies those pulses to each of the row electrodes Y1 to Yn at predetermined timing. Similarly, the row electrode driving circuit 41 also generates various driving pulses and supplies those pulses to each of the row electrodes X1 to Xn at predetermined timing. The column electrode driving circuit 21 generates the pixel data pulses according to the pixel data corresponding to the first to nth rows of the display screen and sequentially applies the pixel data pulses to the column electrodes Z1 to Zm. A pulse generating circuit to generate various driving pulses is provided in each of the row electrode driving circuits 31 and 41 and the column electrode driving circuit 21 for every electrode of each row and each column.

On the basis of the sync timing signal in the video signal supplied to the display panel driving apparatus, the drive control circuit 51 generates various switching signals to control the various driving pulses. The switching signals are supplied to the pulse generating circuit provided in each of the column electrode driving circuit 21 and the row electrode driving circuits 31 and 41.

Figure 5:
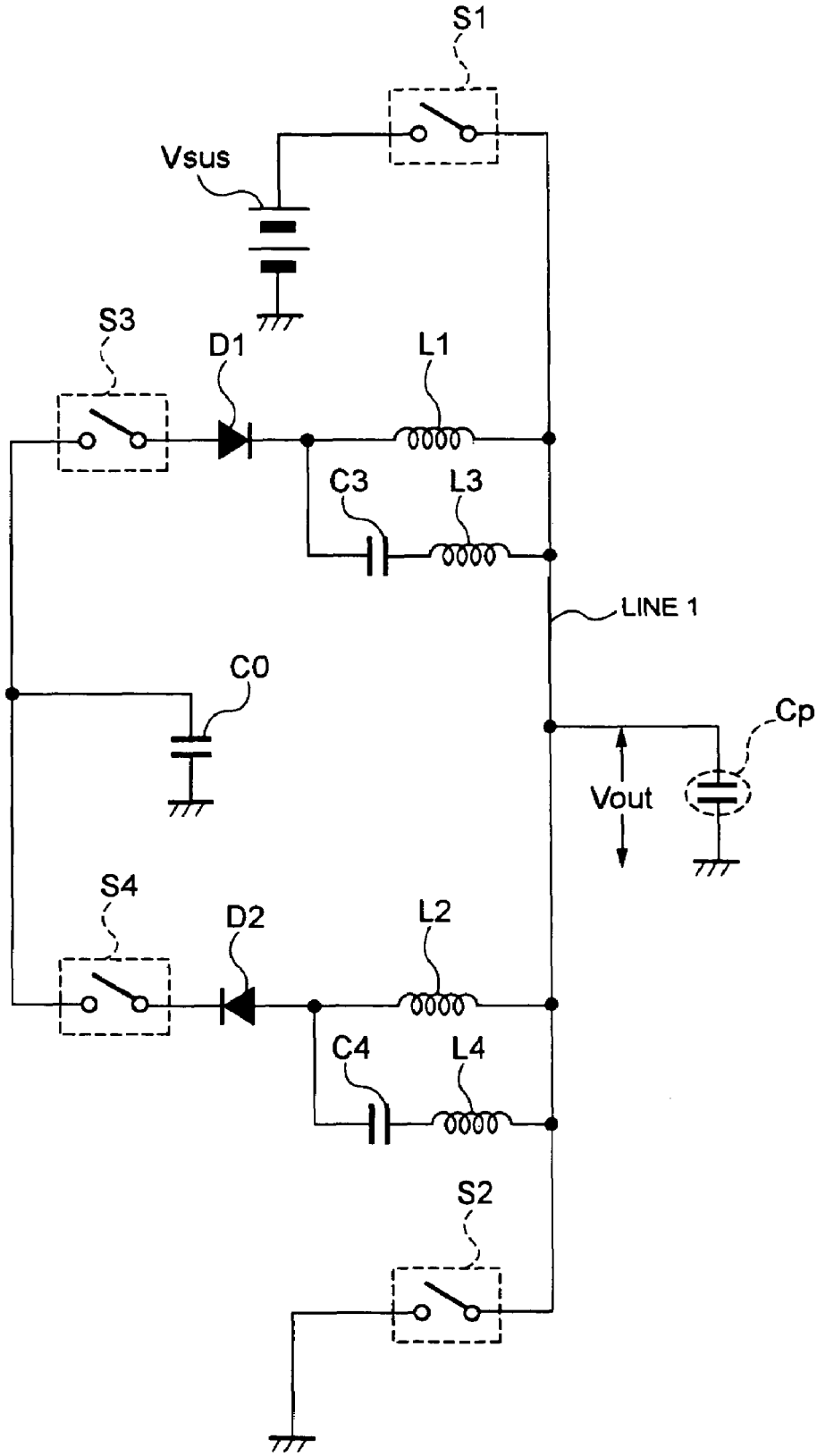
FIG. 5 is a circuit diagram showing a construction of a pulse generating circuit as a first embodiment of the invention.

FIG. 5 shows a construction of the pulse generating circuit provided in each of the column electrode driving circuit 21 and the row electrode driving circuits 31 and 41 for every column electrodes Z1 to Zm or every row electrodes X1 to Xn or row electrodes Y1 to Yn of the PDP 11.

In the diagram, a line 1 is an output line to each electrode of X, Y, or Z in the PDP 11. The panel capacitor Cp is a capacitor which each discharging cell on the PDP 11 has every electrode and is connected to the line 1 through each electrode (not shown).

In FIG. 5, one end of a switch S1 is connected to the line 1 and the other end is connected to a positive side terminal of a DC power source Vsus. A negative side terminal of the DC power source is connected to a reference potential of the display panel driving apparatus. The switch S1 is a switching device such as transistor or FET and it is assumed that S1 is ON/OFF controlled by the switching signal supplied from the drive control circuit 51.

One end of the charge resonance circuit of Cp comprising a series branch of the inductor L1, diode D1, and switch S3 is connected to the line 1 and the other end of the series branch is connected to one end of the capacitor CO for collecting the electric power. A series branch of an inductor L3 and a capacitor C3 constructing a harmonic multiplexing circuit is connected to L1 in parallel.

Similarly, one end of the discharge resonance circuit of Cp comprising a series branch of the inductor L2, the diode D2, and a switch S4 is connected to the line 1 and the other end of the series branch is connected to one end of the capacitor C0 for collecting the electric power. A series branch of an inductor L4 and a capacitor C4 constructing a harmonic multiplexing circuit is connected to L2 in parallel.

The line 1 is connected to one end of the switch S2 and the other end of S2 is connected to the reference potential. Similarly, the other end of the capacitor C0 for collecting the electric power is also connected to the reference potential.

The operation of the pulse generating circuit shown in FIG. 5 will now be described.

First, when S3 is turned on at predetermined timing by the switching signal from the drive control circuit 51, the charges accumulated in C0 are moved to Cp and Cp is charged.

Figure 6:
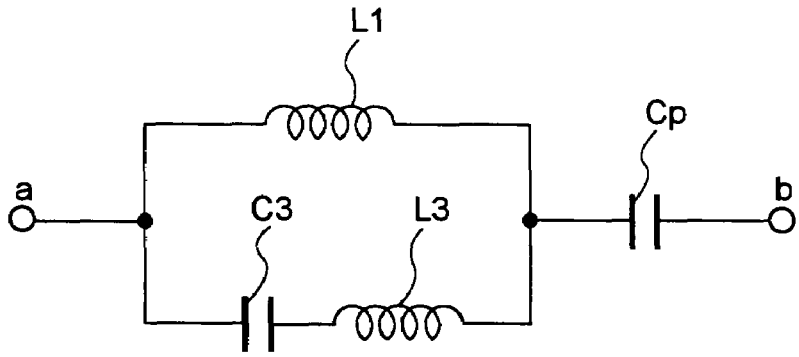
FIG. 6 is a circuit diagram showing a construction of a charge resonance circuit in the circuit of FIG. 5.
Figure 7:
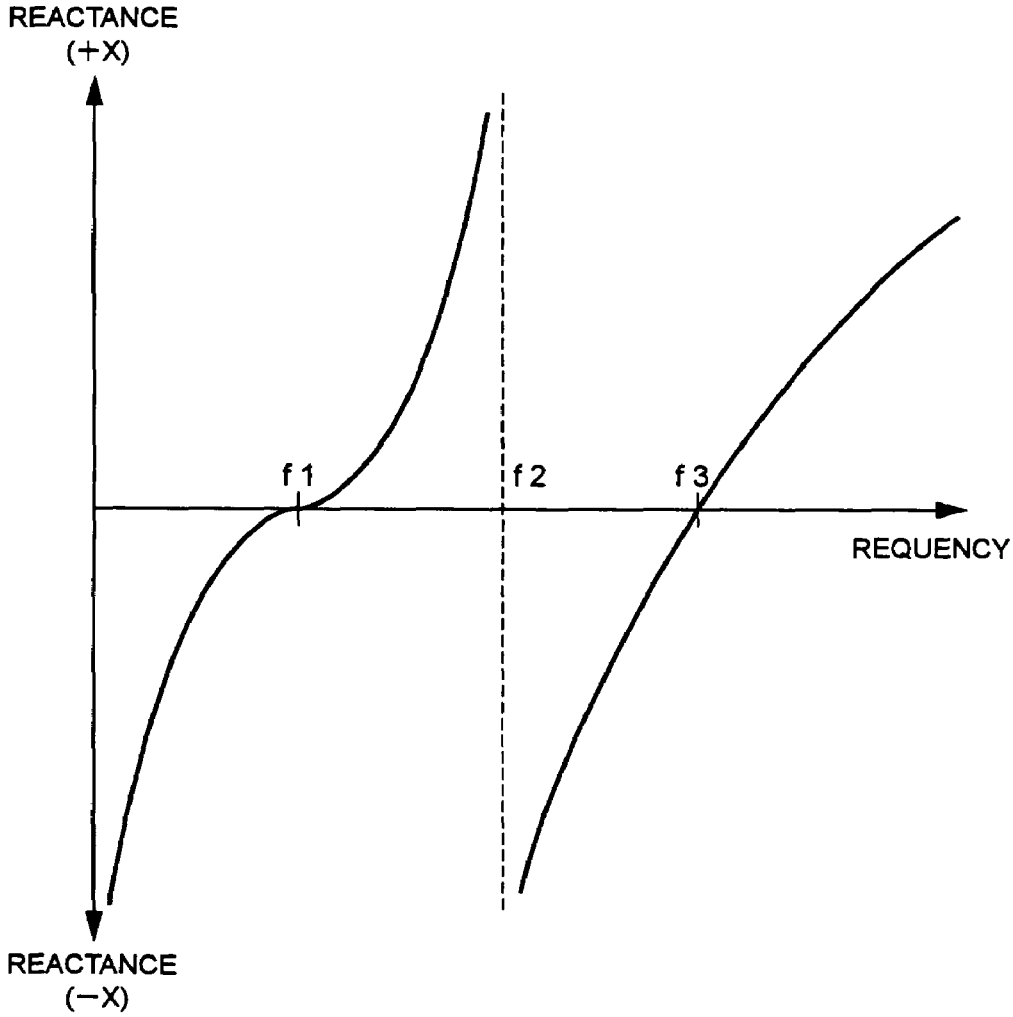
FIG. 7 is a diagram showing frequency characteristics of the charge resonance circuit shown in FIG. 6.

Attention is now paid to the charge resonance circuit formed upon charging of Cp, the circuit can be expressed as a 2-terminal circuit network between terminals a and b as shown in FIG. 6. Frequency characteristics of a reactance Xab of the 2-terminal circuit network are as shown in FIG. 7. That is, Xab has two resonance points f1 and f3 and one anti-resonance point f2 on its frequency axis. The resonance frequency f1 is a resonance frequency that is inherent to the charge resonance circuit and is mainly specified by L1 and Cp. The resonance frequency f3 is a frequency that is specified by L3 and C3 included in the harmonic multiplexing circuit connected to L1 in parallel.

Figure 8:
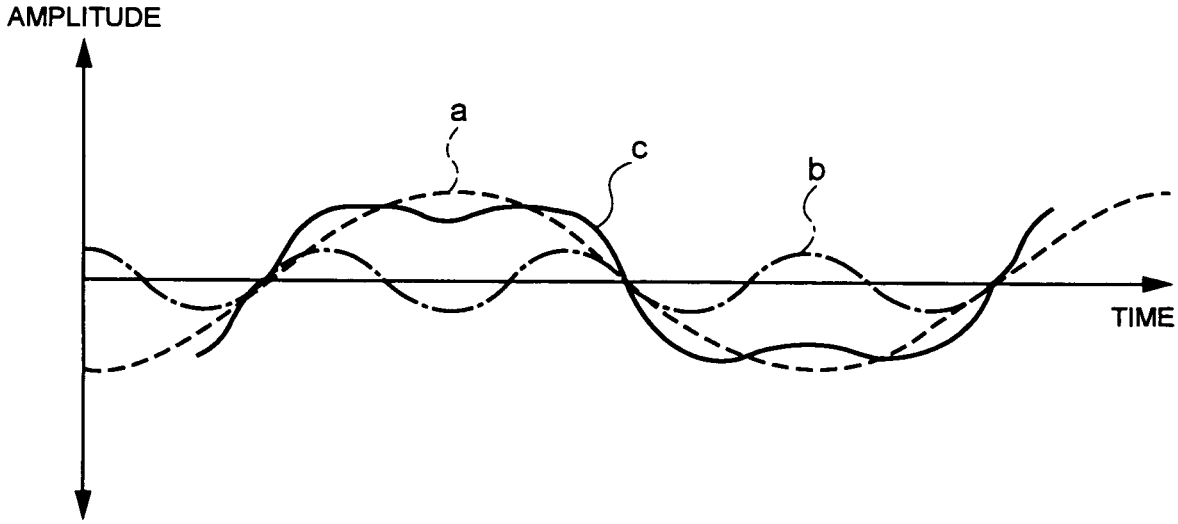
FIG. 8 is a diagram showing states of currents flowing in the charge resonance circuit shown in FIG. 6.

Device values of L3 and C3 are adjusted to predetermined values and f3 is determined so as to satisfy $$f3=3\times f1$$

that is, so as to become the third harmonic in which f1 is used as a fundamental wave. The charge current flowing in the charge resonance circuit has a waveform as shown by a solid line (c) in which a fundamental wave component (a) (broken line) of the resonance current flowing in L1 and a third harmonic component (b) (alternate long and short dash line) of the resonance current flowing in L3 and C3 are multiplexed as shown in FIG. 8.

When a terminal voltage Vout of Cp rises by charging and reaches a predetermined voltage, S3 is turned off by the switching signal from the drive control circuit 51. In place of it, the switch S1 is turned on and the terminal voltage Vout of Cp is fixed to the voltage Vsus of the DC power source. Subsequently, S1 is turned off and the switch S4 is turned on in place of it after the elapse of a predetermined time.

The discharge current from Cp, thus, flows in the capacitor C0 for collecting the electric power. In this case, a discharge resonance circuit formed by L2, L4, C4, Cp, and the like is also of the same type as that of the reactance Xab shown in FIG. 6 and its frequency characteristics are also similar to those in FIG. 7 mentioned above. That is, the resonance current upon discharging also has a current waveform as shown by the solid line (c) in FIG. 8 in which the third harmonic is multiplexed to the fundamental wave of the resonance frequency.

When the charges necessary to charge the capacitor Cp to a predetermined voltage V are assumed to be Q, Q is obtained as $$Q=Cp\times V$$

from the relation between an electrostatic capacitance and the applied voltage.

Since the value obtained by integrating the current along the time becomes charges, as shown by a solid line (a) in FIG. 9, the charge current is a rectangular wave current of a peak value I and if it is assumed that the time required to charge Cp lies within a range from t=0 to t=T, the charges Q can be defined as follows.

$$Q=I\times T$$

Figure 9:
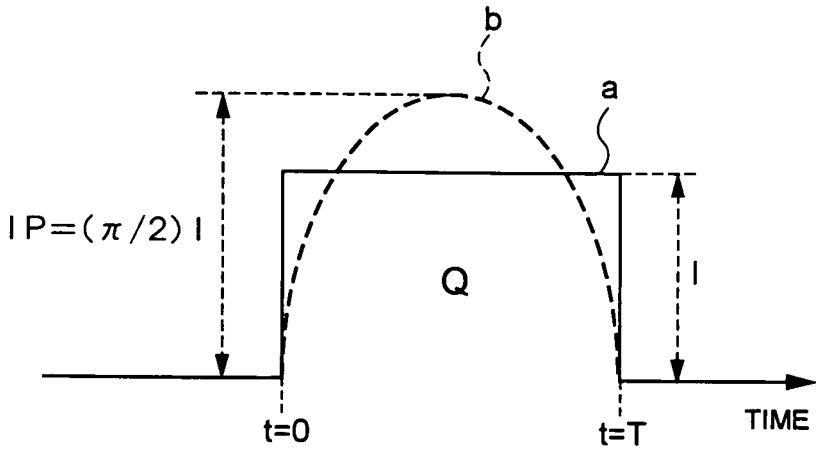
FIG. 9 is a diagram explaining a difference between peak values of charge/discharge currents according to a rectangular wave and a sine wave when the same charges are charged and discharged.

When the charges Q of the same amount as that mentioned above are charged by the sine wave current within the same time T, a peak value Ip of the sine wave is obtained by $$Ip=(\Pi/2)\times I$$

as shown by a broken line (b) in FIG. 9.

Now, considering only a period of time from t=0 to t =T, an effective value of the rectangular wave (a) is equal to the peak value I. An effective value of the sine wave (b) is obtained by $$Ip/\sqrt{2}=(\Pi/2/2)\times I\approx 1.11\times I$$

and is larger than the effective value I of the rectangular wave.

When a resistance component included in each device constructing the charge/discharge circuit or in each electrode of the PDP 11 is assumed to be R and an effective value of the current flowing there is assumed to be Irms, an electric power loss W which is caused in the resistance component R upon charging/discharging can be expressed by $$W=R\times(Irms)^2$$

When an electric power loss upon charging/discharging by the rectangular wave is labeled as W1 and that by the sine wave is labeled as W2, $$W1=R\times I^2$$

$$W2\approx R\times(1.11\times I)^2\approx W1\times 1.23$$

The electric power loss at the time of the sine wave is increased by about 23% as compared with that in the case of the rectangular wave. On the contrary, even in the case of charging/discharging the charges of the same amount to Cp, by setting the waveform of the charge/discharge current to the rectangular wave, the electric power loss can be reduced compared with that in the case of the sine wave.

In the embodiment, when Cp is charged/discharged, by multiplexing the third harmonic component to the fundamental wave component of the resonance frequency of the charge/discharge current, the waveform of the charge/discharge current is made to be approximated to the rectangular wave as shown in the solid line (c) in FIG. 8, thereby reducing the electric power loss upon charging/discharging.

EMBODIMENT 2

The second embodiment of a display panel driving apparatus according to the invention will now be described. A construction of the display panel driving apparatus according to the second embodiment is similar to that in the first embodiment shown in FIG. 4 and only a construction of the pulse generating circuit included in each of the electrode driving circuits 21, 31, and 41 differs from that in the first embodiment. A disclosure and explanation about the whole display panel driving apparatus, therefore, are omitted here.

Figure 10:
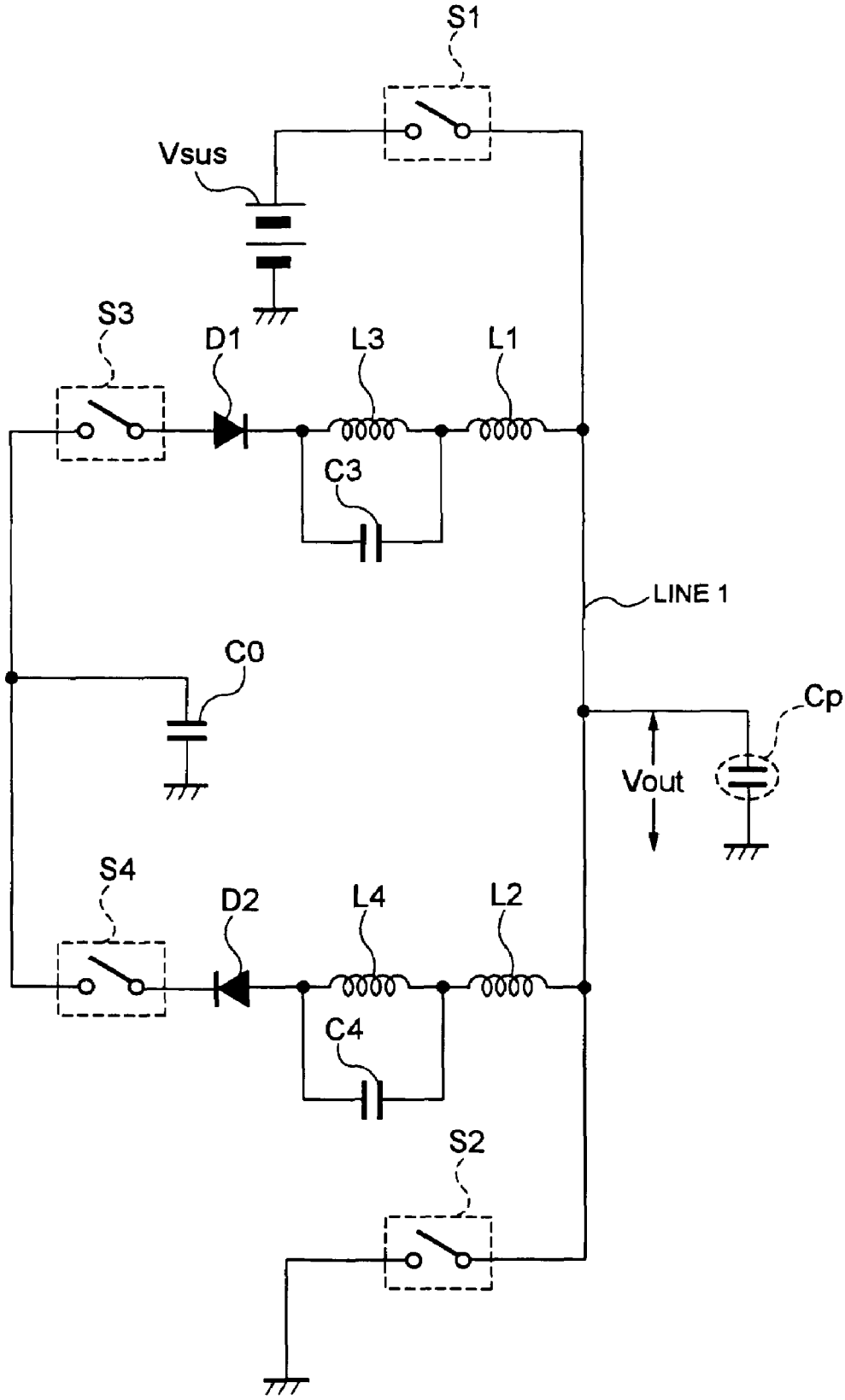
FIG. 10 is a circuit diagram showing a construction of a pulse generating circuit as a second embodiment of the invention.

FIG. 10 shows a construction of the pulse generating circuit according to the second embodiment of the invention. In the diagram, the line 1 denotes the output line to each electrode of X, Y, or Z in the PDP 11. The panel capacitor Cp is a capacitor which each discharging cell on the PDP 11 has every electrode and is connected to the line 1 through each electrode (not shown).

In FIG. 10, one end of the switch S1 is connected to the line 1 and the other end of S1 is connected to the positive side terminal of the DC power source Vsus. The negative side terminal of the DC power source is connected to the reference potential of the display panel driving apparatus. The switch S1 is a switching device such as transistor or FET and it is assumed that S1 is ON/OFF controlled by the switching signal supplied from the drive control circuit 51.

One end of the charge resonance circuit of Cp comprising the series branch of the inductor L1, diode D1, switch S3, etc. is connected to the line 1 and the other end of the series branch is connected to one end of the capacitor C0 for collecting the electric power. A parallel circuit of the inductor L3 and the capacitor C3 constructing a harmonic multiplexing circuit is serially connected to L1.

Similarly, one end of the discharge resonance circuit of Cp comprising a series branch of the inductor L2, the diode D2, switch S4, etc. is connected to the line 1 and the other end of the series branch is connected to one end of the capacitor C0 for collecting the electric power. A parallel circuit of the inductor L4 and the capacitor C4 constructing a harmonic multiplexing circuit is serially connected to L2.

The line 1 is further connected to one end of the switch S2 and the other end of S2 is connected to the reference potential. Similarly, the other end of the capacitor C0 for collecting the electric power is also connected to the reference potential.

The operation of the pulse generating circuit shown in FIG. 10 will now be described.

First, when S3 is turned on at predetermined timing by the switching signal from the drive control circuit 51, the charges accumulated in C0 are moved to Cp and Cp is charged.

Figure 11:
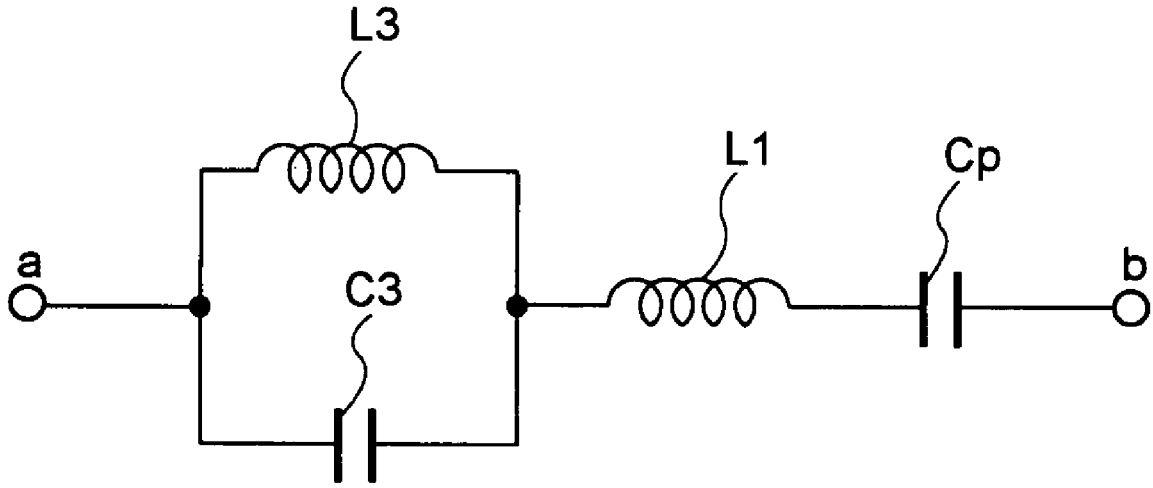
FIG. 11 is a circuit diagram showing a construction of a charge resonance circuit in the circuit of FIG. 10.

Attention is now paid to the charge resonance circuit formed upon charging of Cp, the circuit can be expressed as a 2-terminal circuit network between terminals a and b as shown in FIG. 11. Frequency characteristics of the reactance Xab of the 2-terminal circuit network are the same as those shown in FIG. 7 in the first embodiment. That is, Xab has two resonance points f1 and f3 and one anti-resonance point f2 on its frequency axis. The resonance frequency f1 is a resonance frequency that is inherent to the charge resonance circuit and is mainly specified by L1 and Cp. The resonance frequency f3 is a frequency that is specified by L3 and C3 included in the harmonic multiplexing circuit serially connected to L1.

The device values of L3 and C3 are adjusted to the predetermined values and f3 is determined so as to satisfy $$f3=3\times f1$$

that is, so as to become the third harmonic in which f1 is used as a fundamental wave. The charge current flowing in the charge resonance circuit has a waveform as shown by the solid line (c) in which the fundamental wave component (a) (broken line) of the resonance current flowing in L1 and the third harmonic component (b) (alternate long and short dash line) of the resonance current flowing in L3 and C3 are multiplexed as shown in FIG. 8.

When the terminal voltage Vout of Cp rises by charging and reaches the predetermined voltage, S3 is turned off by the switching signal from the drive control circuit 51. In place of it, the switch S1 is turned on and the terminal voltage Vout of Cp is fixed to the voltage Vsus of the DC power source. Subsequently, S1 is turned off and the switch S4 is turned on in place of it after the elapse of a predetermined time.

The discharge current from Cp, thus, flows in the capacitor C0 for collecting the electric power. In this case, the discharge resonance circuit formed by L2, L4, C4, Cp, and the like is also of the same type as that of the reactance Xab shown in FIG. 11 and its frequency characteristics are also similar to those in FIG. 7 mentioned above. That is, the resonance current upon discharging also has the current waveform as shown by the solid line (c) in FIG. 8 in which the third harmonic is multiplexed to the fundamental wave of the resonance frequency.

Also in the second embodiment, in a manner similar to the case of the first embodiment, when Cp is charged/discharged, the waveform of the charge/discharge current is made to be approximated to the rectangular wave, thereby reducing the electric power loss upon charging/discharging.

Although each of the embodiments has been described above with respect to the case where the charge/discharge current waveform is approximated to the rectangular wave by multiplexing the third harmonic of the resonance frequency of the charge/discharge current when the discharging cells on the display panel are charged/discharged, the invention is not limited to the embodiments. For example, it is also possible to use a construction in which a higher-order odd harmonic such as fifth harmonic or seventh harmonic can be also multiplexed in addition to the third harmonic. By using the construction, since the waveform of the charge/discharge current is further approximated to the rectangular wave, the electric power loss upon charging/discharging can be further reduced.

Although each of the embodiments has been described above with respect to the example using the PDP as a display panel, the invention is not limited to the embodiments. For example, the invention can be also applied to a display panel such as an inorganic or organic EL having capacitive display light-emitting cells.

This application is based on Japanese Patent Application No. 2004-225409 which is hereby incorporated by reference.

What is claimed is:

1. A display panel driving apparatus comprising:

a display panel including a plurality of row electrode pairs, a plurality of column electrodes arranged so as to cross said row electrode pairs, and capacitive light-emitting devices arranged in crossing positions of said row electrode pairs and said column electrodes; and a pulse generating part for supplying a driving pulse to each of said capacitive light-emitting devices, wherein said pulse generating part includes:

a charge/discharge resonance circuit for executing charging and discharging to said capacitive light-emitting devices through an inductor; and a harmonic multiplexing circuit for multiplexing a harmonic current having a harmonic frequency of a resonance frequency of said charge/discharge resonance circuit to each of a charge current and a discharge current by said charge/discharge resonance circuit, wherein said harmonic multiplexing circuit includes a reactance device unit connected to said inductor in parallel, and wherein said reactance device unit comprises a series circuit of an inductor and a capacitor which decide said harmonic frequency.

2. A display panel driving apparatus, comprising:

a display panel including a plurality of row electrode pairs. a plurality of column electrodes arranged so as to cross said row electrode pairs, and capacitive light-emitting devices arranged in crossing positions of said row electrode pairs and said column electrodes; and a pulse generating part for supplying a driving pulse to each of said capacitive light-emitting devices, wherein said pulse generating part includes:

a charge/discharge resonance circuit for executing charging and discharging to said capacitive light-emitting devices through an inductor; and a harmonic multiplexing circuit for multiplexing a harmonic current having a harmonic frequency of a resonance frequency of said charge/discharge resonance circuit to each of a charge current and a discharge current by said charge/discharge resonance circuit, wherein said harmonic multiplexing circuit includes a reactance device unit serially connected to said inductor, wherein said reactance device unit comprises a parallel circuit of the inductor and a capacitor which decide said harmonic frequency.

3. A display panel driving apparatus, comprising:

a display panel including a plurality of row electrode pairs, a plurality of column electrodes arranged so as to cross said row electrode pairs, and capacitive light-emitting devices arranged in crossing positions of said row electrode pairs and said column electrodes; and a pulse generating part for supplying a driving pulse to each of said capacitive light-emitting devices, wherein said pulse generating part includes:

a charge/discharge resonance circuit for executing charging and discharging to said capacitive light-emitting devices through an inductor, and a harmonic multiplexing circuit for multiplexing a harmonic current having a harmonic frequency of a resonance frequency of said charge/discharge resonance circuit to each of a charge current and a discharge current by said charge/discharge resonance circuit, and wherein said harmonic frequency is an odd harmonic of said resonance frequency.

4. An apparatus according to claim 3, wherein said harmonic frequency is a third harmonic of said resonance frequency.

* * * * *